US005222334A

United States Patent [19]

Hasty

[11] Patent Number: 5,222,334

[45] Date of Patent: * Jun. 29, 1993

[54] MULTIPLE SIZE VENT-PIPE ELASTOMERIC COLLAR

[76] Inventor: William E. Hasty, 5230 Del Roy, Dallas, Tex. 75229

[ * ] Notice: The portion of the term of this patent subsequent to Aug. 6, 2008 has been disclaimed.

[21] Appl. No.: 713,315

[22] Filed: Jun. 11, 1991

Related U.S. Application Data

[60] Division of Ser. No. 298,360, Jan. 18, 1989, which is a continuation-in-part of Ser. No. 136,610, Dec. 22, 1987, Pat. No. 4,864,782.

[51] Int. Cl.[5] ..... E04D 13/14

[52] U.S. Cl. ..... 52/100; 52/58; 52/199; 52/219; 285/4; 285/42

[58] Field of Search ..... 52/58, 60, 98, 99, 100, 52/198, 199, 218, 219; 285/4, 42, 43, 44

[56] References Cited

U.S. PATENT DOCUMENTS

| | | | |
|---|---|---|---|
| 1,258,884 | 3/1918 | Fife . | |
| 1,317,446 | 9/1919 | Hollaender, Jr. . | |
| 1,615,929 | 2/1927 | Buckles et al. . | |
| 2,510,926 | 6/1950 | Goldstein . | |
| 2,904,354 | 9/1959 | Kifer . | |
| 3,098,663 | 7/1963 | Dibley . | |
| 3,125,357 | 3/1964 | Kifer . | |
| 3,313,559 | 3/1967 | Kifer . | |
| 3,436,880 | 4/1969 | Kifer . | |
| 3,602,530 | 8/1971 | Elwart . | |
| 3,677,576 | 7/1972 | Gustafson . | |
| 3,731,952 | 5/1976 | Elwart . | |
| 3,807,110 | 4/1974 | Kaminski . | |
| 3,866,950 | 2/1975 | Skoch et al. . | |
| 3,945,163 | 3/1976 | Nagler et al. . | |
| 4,010,578 | 3/1977 | Logsdon . | |
| 4,120,129 | 10/1978 | Nagler et al. . | |
| 4,160,347 | 7/1979 | Logsdon . | |
| 4,265,058 | 5/1981 | Logsdon . | |
| 4,333,660 | 6/1982 | Cupit | 52/60 |
| 4,526,407 | 7/1985 | Kifer . | |
| 4,563,847 | 1/1986 | Hasty | 52/219 |

FOREIGN PATENT DOCUMENTS

| | | |
|---|---|---|
| 640736 | 5/1962 | Canada . |
| 1310003 | 3/1973 | United Kingdom . |
| 1355517 | 6/1974 | United Kingdom . |

*Primary Examiner*—Michael Safavi

*Attorney, Agent, or Firm*—Fitzpatrick, Cella, Harper & Scinto

[57] ABSTRACT

A flashing including an elastomeric collar with an inner surface and an outer surface and adapted to seal against more than one size of a vent pipe passing vertically through a central opening in the collar. The elastomeric collar has a circular base adapted for interconnection with a base member and a central opening including, a first annular ring defined by a first separation circle and a second separation circle, at least one additional annular ring outwardly therefrom that is frangibly separable from the first annular ring at the second separation circle and frangibly separable from the elastomeric collar at a third separation circle. Each annular ring selectively is removable by a pull tab that extends vertically from the outer surface of each annular ring at a location proximate to the separation circle of that ring with respect to the elastomeric collar.

6 Claims, 4 Drawing Sheets

MULTIPLE SIZE VENT-PIPE ELASTOMERIC COLLAR

This application is a division of copending prior application Ser. No. 07/298,360, filed Jan. 18, 1989, which application is a continuation-in-part of prior application Ser. No. 07/136,610, filed on Dec. 22, 1987, now U.S. Pat. No. 4,864,782.

BACKGROUND OF THE INVENTION

Field of the invention

An improved flashing for roof top vent pipes, characterized by a sealing collar of soft, elastomeric material which is frustoconical and further is intended to be mounted upon a frustoconical flashing base member, or integrated into a one-piece flashing. The invention resides in the manner of permitting separations of individual annular rings, so that a single flashing can be used to accommodate a plurality of differing diameter vent pipes.

Cross-reference to related applications

This application is a divisional of U.S. patent application Ser. No. 07/298,360, now U.S. Pat. No. 5,036,636, which application was a continuation-in-part of my U.S. patent application Ser. No. 07/136.610.

Brief description of the prior art

The present invention represents a structural improvement upon the sealing collar taught within applicant's prior patent, HASTY, U.S. Pat. No. 4,563,847. As in applicant's prior patent, the present invention permits a single flashing to accommodate more than one vent pipe diameter, wherein larger vent pipe diameters are sealed simply by separating one or more annular rings through a frangible disconnect within the sealing ring collar. The elastomeric collar of the present invention may be overmolded upon a hard plastic base using the technique taught by my pending application Ser. No. 07/136,610, which is incorporated herein by reference for that disclosure. The elastomeric collar of the present invention also may be mounted by crimping onto a hard base of galvanized steel or aluminum, for example. Finally, the elastomeric collar of the present invention may be part of a flashing totally comprised of elastomeric material, and molded in a single unit, in a manner somewhat analogous to the one-piece construction of U.S. Pat. No. 4,563,847.

Examples of other prior art two-piece flashings, having a soft collar and a hard base mounting are LOGSDON (U.S. Pat. No. 4,265,058) and KEIFER (U.S. Pat. No. 4,526,407). The use of two concentric sealing rings, as employed with the present invention, for a single vent pipe diameter is disclosed by KEIFER (U.S. Pat. No. 3,313,559), whereby there will be an overall wiping action by the elastomeric collar. The wiping is effected through distension of a rubber circular element, with at least two concentric rings making contact upon the vent pipe. With respect to use with a metal hard base, wherein an elastomeric collar is to be held in a C-clamp engagement by a corrugated metal flange, such an interconnection per se is shown by FIFE (U.S. Pat. No. 1,258,884) and BUCKLES et al. (U.S. Pat. No. 1,615,929).

Unlike such prior art devices, the present invention is distinguished by a novel elastomeric collar, wherein individual annular rings are separated by pulling on vertically extending tabs, to define a circular sealing that will accommodate, respectively, a 1.5 inch vent pipe, a 2 inch vent pipe, or a 3 inch vent pipe, for example. While the present invention preferred embodiments show sealing arrangements for three vent pipe diameters, the invention also contemplates adding an additional annular ring (and a secondary sealing ring shoulder or vertical sealing tube) for a 4-inch vent pipe. Four embodiments of the present invention incorporate primary and secondary sealing, wherein distension of the first annular surface is greater than that of the second sealing ring shoulder surface, as part of a novel universal vent pipe size flashing. Unlike the prior art, the present invention teaches a universal type of elastomeric collar wherein primary and secondary sealing is not compromised by the fact that individual end-rings are easily are ripped off from the top. The use of upwardly extending pull tabs, and associated primary frangible sections, prevents weakening of the elastomeric collar at outer annular rings not intended to be disturbed, during the ripping of an inner annular ring. A fifth embodiment covers the top of a vent pipe, and thereby seals the entire outer surface of the vent pipe.

BRIEF SUMMARY OF THE INVENTION

Each embodiment of the present invention comprises an elastomeric collar generally frustoconical in shape, with spaced pull tabs, extending up from the outer surface. In a preferred embodiment, the elastomeric collar of soft plastic is mounted by an overmolding technique, upon a hard plastic frustoconical base unit. The overmolding interconnection itself may be substantially equivalent to the technique shown in may copending application Ser. No. 07/136,610. The elastomeric collar of the present invention is distinguished from the universal elastomeric collar ring shown by HASTY (U.S. Pat. No. 4,563,847) in that no cutting is required. Rather, individual rings are removed by prominent pull tabs. Each pull tab extends outwardly from the collar outer surface at a point that is proximate and spaced above a lower frangible section associated with that annular ring section. In the preferred embodiment, there are two annular rings able to be removed by the user, to define a 3-in-1 size flashing. A particularly simple way to mold such an elastomeric collar is to mold the collar with three pull tabs, whereby the innermost pull tab allows a central gating and disk (needed for symmetrical molding purposes) to be removed easily, prior to shipment of the flashing to an end-user.

The present invention has undergone performance testing by Ramtech Testing Laboratories, Inc. for a water test, ultraviolet, aging and etc. to meet UPC, BOCA, and Southern Building Codes. National plumbing code approvals have been granted upon flashings with an elastomeric collar according to the present invention. (See UPC File Number 2326; BOCA File Number 88-56; Southern Building Code File Number 8889).

The hard base preferably is manufactured of POLYTROPE ™, a polypropylene blend, which has an approximate 360° F. melting point, and is available from Schulman Company (Part No. TPP-1201-32UHG Black). Another hard base material is polypropylene material sold as Novalene ™, by Nova Polymers, Inc. The preferred embodiment elastomeric collar material is available from Schulman Company, and comprises a soft polypropylene blend, sold as POLYTROPE ™ (Part No. TPP-444-31 HF Black). Another useful polypropylene is a soft Novalene ™. Applicant also has molded elastomeric collars comprised of a flexible Polyvinyl chloride (PVC) plastic, and a preferred flexible PVC is available from Roscom Company (Part No. 605-60-UVF Black). Where, in the following discussion of embodiments of the invention, the term "hard base" is used, it is to be understood that various hard materials, such as rigid plastics, aluminum or galvanized steel are intended. Likewise, where "flexible" or "soft rubber" collar is used, it is to be understood that flexible polypropylene polymer blends, flexible PVC blends, and various other sealing plastic or rubbers, well-known for this purpose, also are intended.

The present invention essentially comprises an elastomeric collar, that is intended to be part of, or physically attached to, a frustoconical member that has a flange to mount against a roof surface and define the overall vent pipe flashing unit. The following discussion, therefore, first will concentrate upon the elastomeric collar details, since the elastomeric collar pull tab feature is common to all embodiments. The elastomeric collar may comprise a plurality of rings that are concentric and frangible from each other in order to reveal distensible surfaces that perform a first and separate wiping function, upon the outer diameter of a given vent pipe diameter. Improvement also resides in a frangible interconnection, between each annular ring, so that each ring is outwardly connected to an adjacent portion of the collar by a separation circle reduced wall thickness cross-sectional area that is below and has an arcuate section proximate to a pull tab extending outwardly from the collar outer surface of the ring to be removed. The separation circle between annular rings further comprises a primary frangible section and a secondary frangible section. The primary frangible section is located immediately below and extends in an arc slightly beyond a leading and a trailing edge of the associated pull tab. Each pull tab preferably is defined as a curved member, so that a concave and substantially vertical surface will be positioned facing upwardly, when a flashing according to the present invention is used on a sloped roof application. Further, each of the two pull tabs of the preferred embodiment are disposed at an acute angle and on opposite sides of the intersection of a front-to-back vertical plane, through the flashing, as the flashing is installed on a sloped roof. Such a substantially symmetrical arrangement of pull tabs affords structural integrity to each frangible interconnection, whereby removal of an inner ring will not tend also to separate an outward frangible separation circle. Further, the concave upward surface of each pull tab resists the likelihood of ice damming, since water won't collect on the concave upper surface of a pull tab. Since a pull tab is above a primary separation thickness, (defined in an arc along the inner surface of a separation circle) removal of an annular ring is by grasping the pull tab with a pliers, and pulling substantially vertically upward. In that manner, a clean separation extends circumferentially around the separation circle, from either side of the pull tab. The primary separation thickness directly under each pull tab preferably extends only about 1.25 inches in an arc along the frangible separation circle around each annular ring, of the elastomeric collar. The secondary separation thickness of each separation circle preferably has an increased thickness, in the direction of increasing diameters. In other words, while the primary separation thickness for both the two-inch vent pipe, and the three-inch vent pipe tear rings may be between 0.015 inches and 0.020 inches, the two inch vent pipe secondary separation thickness is approximately 0.040 inches, and the three inch vent pipe secondary separation thickness is approximately 0.050 inches. In this fashion, there is a relative stiffening of the elastomeric collar in the direction towards the outer flange mounting location of the collar.

For a further understanding of the objects and advantages of the present invention, several embodiments hereafter will be described, wherein reference is made to the accompanying drawings.

DESCRIPTION OF THE PREFERRED EMBODIMENTS

The first and preferred embodiment of the present invention shown in FIGS. 1–3 and 5, comprises an elastomeric collar 2, having an outer circular base 4 that actually will be part of an overmolding upon a horizontal flange of a hard plastic base, in a manner substantially equivalent to the technique shown in my copending application Ser. No. 07/136,610. Such an overmolding technique also schematically is illustrated in the embodiment of FIG. 6, but applicant incorporates by reference the overmolding technique of copending application Ser. No. 07/136,610 for further details of a preferred technique for overmolding the elastomeric collar, 2, upon the flange of a frustoconical base member.

The preferred embodiment further comprises a central disc, 6, that facilitates injection molding of the elastomeric collar by a symmetrical gating of thermoplastic material, about the vertical axis of symmetry of the collar. The central disc, 6, preferably is removed soon after molding and prior to shipment to an end user by a first pull tab, 12, to thereby define a first diameter, A, at the first separation circle, 7.

Figure 1:
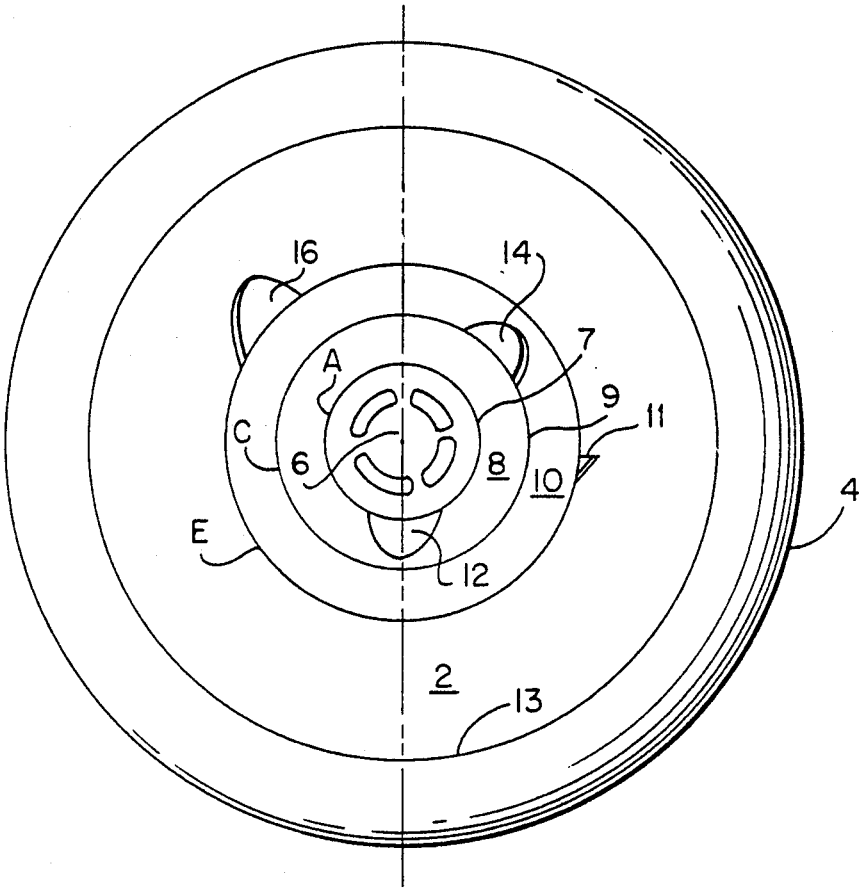
FIG. 1 is a top plan view of an elastomeric collar, molded according to a preferred embodiment of the present invention.
Figure 5:
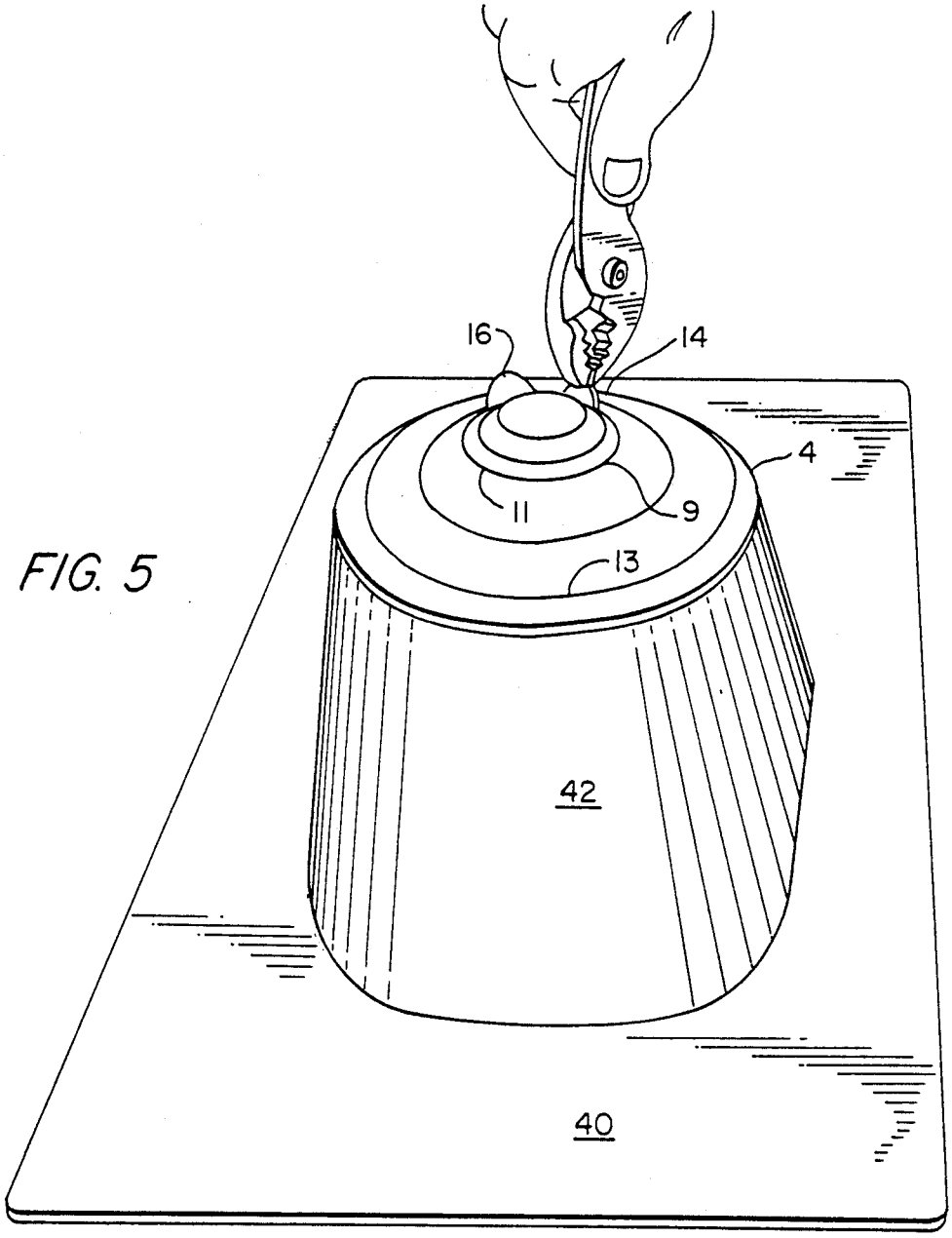
FIG. 5 is a front elevation view showing use of pliers to remove a first annular ring so as to define sealing surfaces for a two-inch vent pipe for the preferred embodiment.
Figure 6:
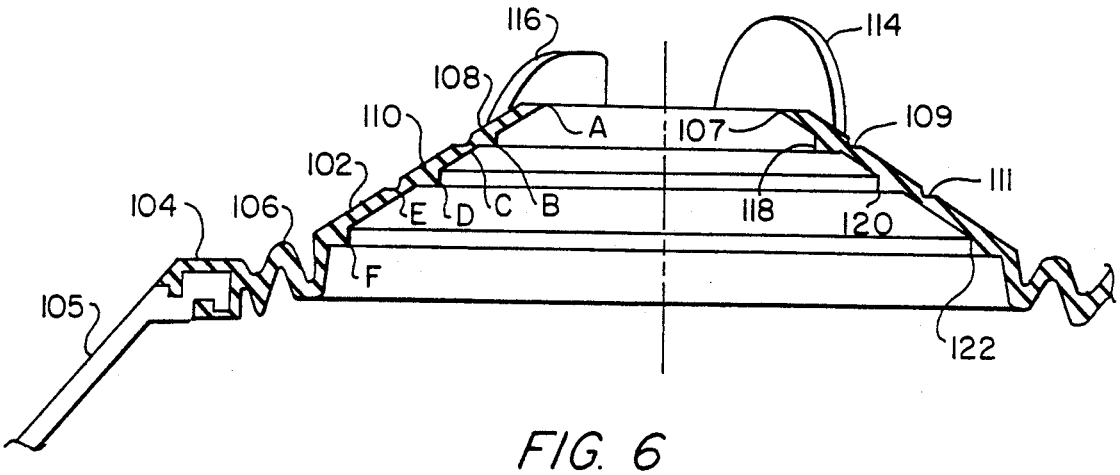
FIG. 6 is a front elevation view, in vertical cross section, of a third embodiment wherein the collar has a horizontal accordion section, and is overmolded upon a plastic hard base support.

As shown in FIG. 5, the elastomeric collar circular base has been overmolded upon a frustoconical section 42, that preferably is of hard plastic, and connects to a flat base flange, 40, adapted for mounting upon an inclined roof surface according to the intended use. FIG. 5 shows removal of a first annular ring, 8 defined between a first separation circle 7 of a diameter A and a second separation circle 9 of a diameter C. A second pull tab 14 is proximate an arc of a second separation circle 9. A second annular ring, 10 likewise is defined between the diameter C and a third separation circle 11 of a diameter E. A third pull tab 16, is proximate an arc of the third separation circle, 11. Accordingly, the present invention permits either diameter C to be exposed by grasping the second pull tab 14 with pliers, as shown in FIG. 5, and pulling substantially upward so as to tear in two directions along second separation circle, 9. In the same manner diameter E is defined by separating at the third separation circle 11 by grasping third pull tab, 16 and pulling also substantially upward. The second and third pull tabs, 14, 16 are spaced as shown in FIG. 5 so as to be substantially symmetrical and disposed on either side of a vertical plane of symmetry, as shown in FIG. 1. As further illustrated in FIG. 5, the spacing of the pull tabs allows the concave surfaces of each to be facing relatively downward when the flange 40, is mounted upon a pitched roof. In this fashion any water will tend to flow around the outer or convex surface of each pull tab and downwardly away from the concave or radially inner surface of each pull tab. In this fashion, ice damming is lessened, and the change of water collecting against each concave surface is eliminated.

The preferred plastic material for the elastomeric collar of FIG. 1 is a soft polypropylene blend, as discussed hereinbefore, and may be POLYTROPE™ available from Schulman Company (Part No. TPP-444-31 HF Black). The preferred embodiment also may be molded of a flexible polyvinylchloride (PVC plastic), and a preferred flexible PVC is available from Roscom Company (Part No. 605-60 UVF Black).

Figure 3:
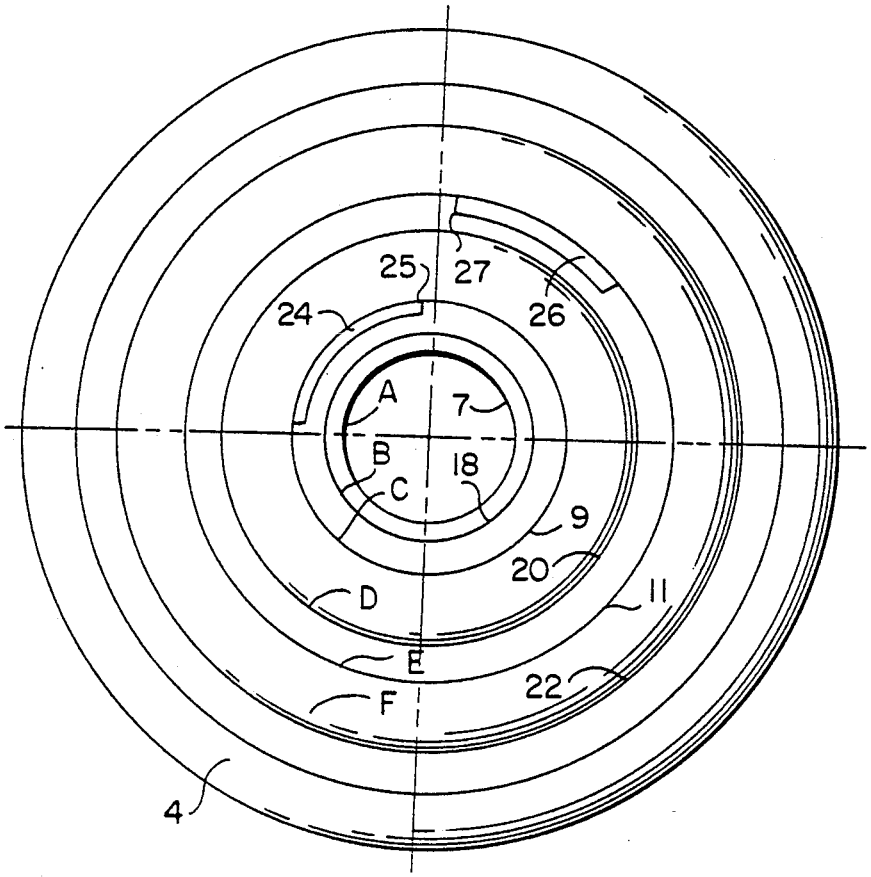
FIG. 3 is a bottom plan view of the elastomeric collar of FIG. 2, showing schematically a flat outer flange that would be overmolded upon a plastic hard base support.

To illustrate how each of the plurality of annular rings perform both a primary and a secondary sealing function upon an outer diameter of a given vent pipe diameter, reference is made to a bottom view of the preferred embodiment, in FIG. 3. The first separation circle 7 has a diameter A designed to sealingly wipe against the outer diameter of a first or small vent pipe. The diameter A preferably is on the order of 1.25 inches to 1.35 inches and is distensible to accommodate the outer diameter of 1.25 or 1.5 inch nominal inner diameter vent pipe, as a first primary seal. A first secondary seal is accomplished by distension of a first secondary shoulder 18, which has a nominal diameter B. The preferred value for diameter B is 1.5 inches, to be distended by a nominal 1.5 inch vent pipe outer surface.

In the event a 2 inch vent pipe is to be used, a frangible separation of the first annular ring 8 is made along the second separation circle, 9, to define a second primary seal of a diameter C. The preferred value for diameter C is 1.75 inches, so that it will be distended substantially by the outer diameter of a nominal 2 inch inner diameter vent pipe. A second secondary seal for 2 inch vent pipe is accomplished by distension of a second secondary shoulder, 20, which has a nominal diameter D. The preferred value for diameter D is 2.0 inches.

In the event a 3 inch vent pipe is to be used, second annular ring 10 is separated along the third separation circle 11, to define a third primary seal of a diameter E. The preferred value for diameter E is 2.5 inches. A third secondary seal for a 3 inch vent pipe is accomplished by distension of a third secondary shoulder, 22, which has a nominal diameter F. The preferred value for diameter F is 3.0 inches.

With reference to the bottom view of FIG. 3, it can be seen that the second separation circle 9 comprises a second primary frangible section 24, of a reduced wall thickness which has a starting point 25 that is on the left side of the vertical plane of symmetry when looking upwardly at the bottom of the elastomeric collar. Likewise, the third separation circle, 11, comprises a third primary frangible section 26 that has a starting point 27, disposed on the opposite side of the vertical plane of symmetry shown in FIG. 3. The second primary frangible section, 24 preferably is approximately 1.25 inches in arcuate length, and has a wall thickness of approximately 0.015 inches in its middle section, with a slight thickness increase to 0.020 inches, at both the inner end, 25, and the opposite end. The remainder of second separation circle 9 defines a second secondary frangible section that is slightly thicker, and preferably is 0.040 inches. By contrast, the wall thickness of the frustoconical member on either side of the second separation circle is approximately 0.055–0.060 inches. As further shown by FIGS. 1 and 3, the center of the arcuate second primary frangible section, 24 is disposed approximately 15–20 degrees off of the vertical plane. The third primary frangible section, 26 likewise is disposed with the center of its arc approximately 15–20 degrees off the vertical plane of symmetry.

The second pull tab, 14, is disposed substantially symmetrically and above the second primary frangible section, 24, so that a vertical lifting of second pull tab 14, as shown in FIG. 5, will initiate a tearing action that will propagate from the center of the second primary frangible section 24 towards each end thereof, and then continue around both sides of the second separation circle, 9.

Likewise, a third separation circle, 11 comprises a third primary frangible section 26 that is disposed symmetrically and below the third pull tab, 16. The arcuate extent of the third primary frangible section, 26 also preferably is approximately 1.25 inches, and may also have a variable wall thickness of approximately 0.015 inches in its middle, and a gradual increase in thickness to approximately 0.020 inches, at either end. The remainder of the third separation circle, 11, defines a third secondary frangible section by a wall thickness that is approximately 0.050 inches, or greater than the wall thickness of the second secondary frangible section. Hence, the action shown in FIG. 5 will localize a tearing from grasping second pull tab 14 along the second separation circle 9, since its secondary wall thickness is less than the secondary wall thickness along third separation circle, 11. It should also be noted that the first separation circle, 7, preferably has a wall thickness of approximately 0.030 inches, which is less than the secondary separation preferred 0.040 inch wall thickness of separation circle 9, and the preferred 0.050 wall thickness along the third separation circle 11.

Figure 2:
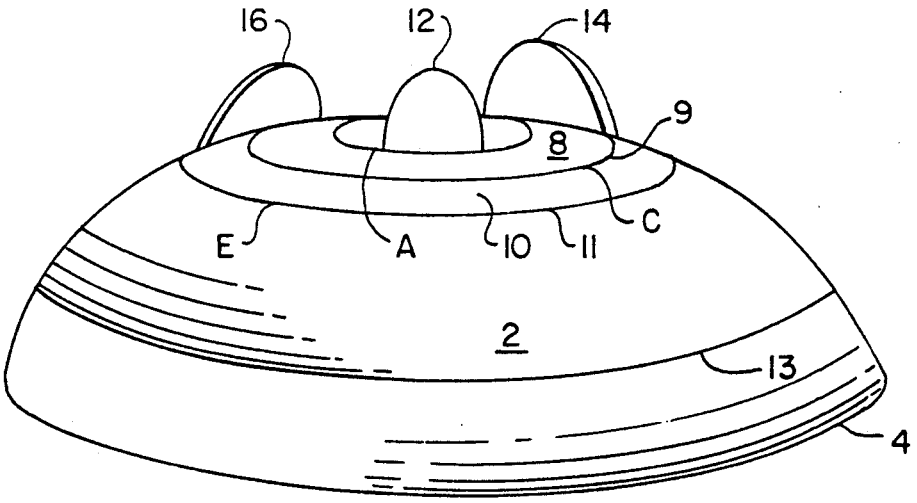
FIG. 2 is a right side elevation view of an elastomeric collar according to FIG. 1.
Figure 4:
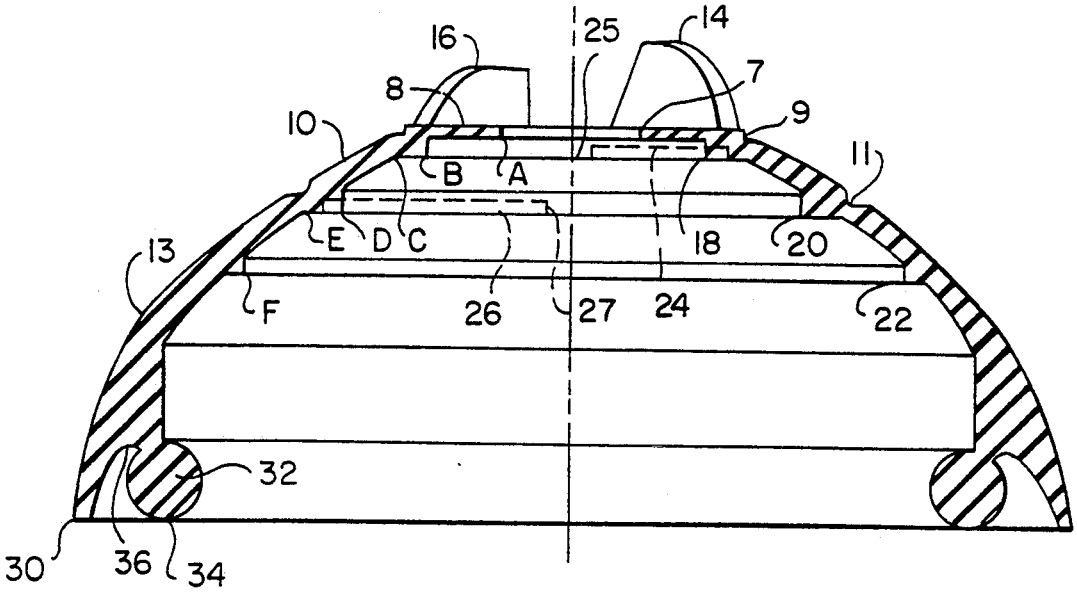
FIG. 4 is a front elevation view showing, in vertical cross-section, a second embodiment wherein the elastomeric collar can be crimped within a metal hard base support.

FIG. 4 illustrates an elastomeric collar second embodiment that is similar to the preferred embodiment of FIGS. 1–3, with like numerals used to identify equivalent structural elements. The second embodiment of FIG. 4 does not have a circular base flange, 4, adapted for overmolding upon a hard plastic frusto-conical member, but instead has a mounting adapted for engaging into a metal base, substantially in the fashion shown by the embodiment of FIG. 7. While a metal mounting base is not shown in FIG. 4, reference may be had to FIG. 7 for the manner in which a solid tubular ring, 32, of a circular cross-section 34, a web section 36, and a narrow outer flange 30 will fit within an upwardly open channel of a steel or aluminum base member.

FIG. 6 illustrates a third embodiment, wherein an elastomeric collar, 102 has a circular overmolding flange, 104 that is shown schematically in place upon a hard plastic base, at 104. Further details of the preferred interconnection between the soft elastomeric collar of FIG. 6 and the flange of the hard plastic base are shown in copending application Ser. No. 07/136,610, incorporated by reference herein for those details of an overmolding between the soft elastomer collar 102 and hard plastic base 105. The third embodiment of FIG. 6 differs from the preferred embodiment of FIGS. 1-3 and 5 by presence of a corrugation section, 106 that will permit relative motion of the elastomeric collar 102 with respect to the hard plastic base, 105. The third embodiment of FIG. 6 permits a sealing on vent pipe diameters that is equivalent to the structure of FIGS. 1-3 and 5. A second pull tab, 114, permits removal of a first annular ring, 108, and a third pull tab 116 permits removal of a second annular ring, 110, so as to respectively reveal base circles having diameters C and E to accomplish primary sealing on 2 inch and 3 inch vent pipes, as in the preferred embodiment. The first separation circle, 107, defines a diameter A, the second separation circle 109 defines a diameter C and the third separation circle 111 defines a diameter E. Likewise, there is a first secondary shoulder 118 that defines a diameter B, a second secondary shoulder 120 that defines a diameter D and a third secondary shoulder 122 that defines a diameter F.

Figure 7:
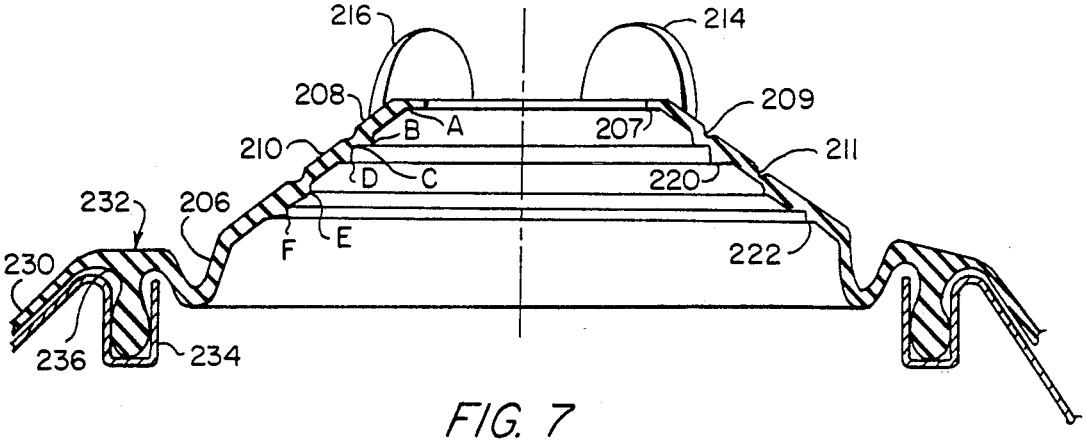
FIG. 7 is a front elevation view, in vertical cross-section of a fourth embodiment wherein the elastomeric collar has a horizontal accordion section, and is crimped within a metal hard base support.

FIG. 7 illustrates a fourth embodiment wherein an elastomeric collar 202 has a first separation circle 207 to define diameter A, a second operation circle 209 to define diameter C and a third separation circle 211, to define diameter E. As in the previous embodiments, a first secondary shoulder 218, defines a diameter B, a second secondary shoulder 220 defines a diameter D and a third secondary shoulder, 222, defines a diameter F. As shown in FIG. 7, the fourth embodiment differs from the third embodiment by an accordian section, 206 with only one convolution, and a mounting for an upwardly open channel, 234 that is part of a metal base. As in the second embodiment of FIG. 4, there is an elastomeric solid tubular ring, 232, a web 236, and a narrow outer flange, 230, which are crimped within a metal channel as shown, in a conventional manner. The corrugation 206 permits some relative motion of the elastomeric collar with respect to the metal base in both the vertical and horizontal directions, to accommodate various stresses which might arise from mounting of the assembly over a vent pipe during placements on roofs having different pitches. The use of a solid tubular ring, 232, mounted within the upwardly open channel, 234 of the metal base per se is a known technique for mounting a soft collar upon a metal base.

The second, third and fourth embodiments may have the elastomeric collar made with any form of soft rubber, as discussed hereinbefore. In the fourth embodiment of FIG. 7 a flexible PVC blend is preferred, since there is no need to match the characteristics of the elastomeric collar soft rubber to any characteristic of a hard plastic base. In the first and third embodiments, the overmolded seal between a hard plastic base and the soft elastomeric collar benefits from using compatible plastics. The mechanical mounting arrangements of the second and fourth embodiments each will seal against a metal base that is accomplished without concern for compatibility of plastic to metal.

In each of the first, second, third and fourth embodiments, there is a distension of a separation circle so as to make a primary seal, and a distension of an associated secondary shoulder, to make a secondary seal against the outer surface of a vent pipe of a given diameter. In the fifth embodiment of FIG. 8, applicant illustrates a multiple-size vent-pipe roof flashing of one-piece semi-rigid plastic, that does not rely upon a distensible sealing technique, but rather relies upon an overlapping seal, over the top of a given vent pipe, when a central opening of various sizes is created.

The fifth embodiment also uses a second pull tab, 314 and a third pull tab 316 to respectively separate a first annular ring 308 and second annular ring 310. However, a first separation circle 307 has a diameter which is significantly less than diameter A shown in previous embodiments. The first separation circle 307 is proximate to the inner surface of a first vertical inner seal tube 330 that has an outer diameter, G. Diameter G preferably is 1.4 inches, so as to provide a slight clearance against the inner diameter of a nominal 1.5 inch vent pipe. The fifth embodiment thereby accomplishes a sealing against the top and inner surfaces of a given vent pipe diameter, instead of against the outer surface of that vent pipe. A second pull tab 314 permits removal of the first annular ring 308 at a frangible section defined by a second separation circle 309 proximate to the inner surface of a second vertical inner seal tube that has an outer diameter, H. Diameter H preferably is 1.9 inches so as to provide a slight clearance against the inner diameter of a nominal 2.0 inch vent pipe. The second pull tab, 314, also is disposed immediately above a second primary frangible section, 324 that is analogous in structure to the second primary frangible section shown in previous embodiments. Likewise, a second annular ring, 310, is removed along a third separation circle, 311, by pulling vertically upward upon a third pull tab, 316 that is disposed immediately above a third primary frangible section, 326. The second annular ring, 310 separates along a third separation circle, 311, that is proximate to the inner surface of a third vertical inner seal tube 334, which has an outer diameter, I. Diameter I preferably is approximately 2.9 inches, so as to provide a slight clearance against the inner diameter of a nominal 3 inch vent pipe.

Figure 8:
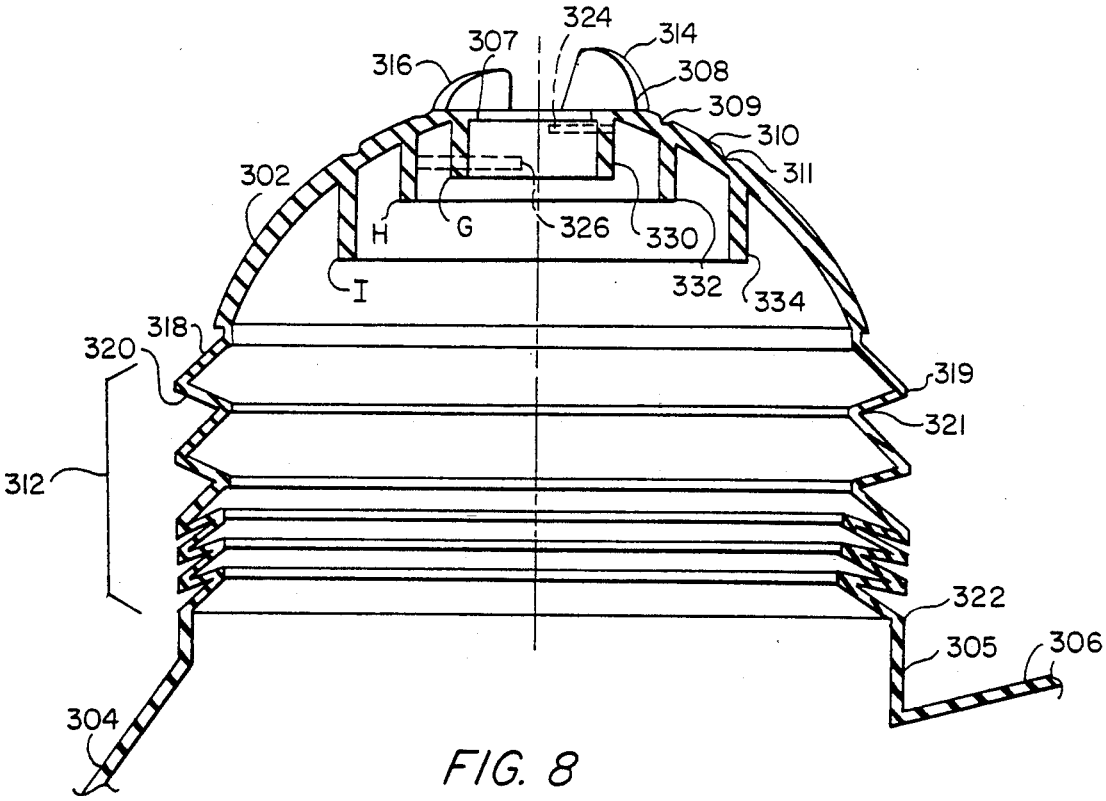
FIG. 8 is a front elevation view in vertical cross-section, of a fifth embodiment wherein the elastomeric collar has a vertical collapsible accordion section, and is of a one-piece construction.

To use the fifth embodiment of FIG. 8 with a nominal 1.5 inch vent pipe, the flange assembly is inserted from above and down upon the pipe, so that the first vertical inner seal tube, 330 outer diameter G is against an inner surface near the top of the vent pipe, and the vent pipe upper surface pushes up against an inner wall of the first annular ring, 308. In like fashion, if a 2 inch vent pipe is to be used, the second pull tab, 314 is used to remove the first annular ring, 308 at the frangible second separation circle, 309, so that the inner surface of a 2 inch vent pipe slides upwardly around the outer surface of the second vertical inner seal tube, 332 and is stopped by the inner surface of the second annular ring, 310. In the event a 3 inch vent pipe is to be used, the second annular ring, 310 is removed by pulling upwardly upon the third pull tab, 316, so as to define a seal between the outer surface of the third vertical inner seal tube, 334 which has an outer diameter I that is slightly smaller than the nominal 3 inch inner diameter of a 3 inch vent pipe. Here again, the top of the vent pipe will press upwardly against the inner surface of a portion of the elastomeric collar 302.

In order to accommodate varying heights of three different vent pipes according to the fifth embodiment of FIG. 8, there is provided a vertical collapsible section, 312 comprising several legs that are individually interconnected so as to remain in either an expanded or contracted mode, as illustrated in FIG. 8. This vertical accordian section comprises a plurality of relatively longer upper legs, 318, connected to a plurality of relatively shorter lower legs, 320 by a thinner outer interconnecting web sections, 319. Likewise, each lower leg is connected to the immediately below upper leg by a thinner inner interconnection web section, 321. Any number of interconnected legs may be provided, and preferably the vertical collapsible section is connected to a frustoconical base portion, 304 at a circular ridge 322. As shown schematically in FIG. 8, any portion of the base element may have an inclined frustoconical section 304, or a relatively vertical section, 305, with each section connected to a flange 306 that should be inclined with its relatively upward section behind the plane of the section view of FIG. 8. The embodiment of FIG. 8 takes advantage of the vertical collapsible section, 312 to define the angularity of the sealing collar with respect to a roof line, and a preferred angularity may be defined so that the second pull tab, 314 and the third pull tab, 316 have convex surfaces facing upwardly in a manner analogous to the embodiments of FIGS. 1-3 and 5.

The vertical accordian section 312 is capable of various open and closed positions, wherein sets of upper and lower legs either are fully extended (as shown at the upper portion) or fully closed and overlapping (as shown at the lower portion). It is known how to create a stable collapsible section of plastic tubing to define accordian section 312 through such a series of corrugations. Applicant incorporates by reference to CLEMENT ET AL. (U.S. Pat. No. 3,908,704) for further disclosure of a corrugated tube that will make close bends without kinking, and will hold its bent form without objectionable spring back. The embodiment of FIG. 8 preferably is molded in one piece using an FHB series blow molding machine, manufactured by Battenfeld Fischer Blow Molding Machines, Inc., of Paramus, N.J. Such machines are capable of making accordian-type plastic elements, and there also is no need for an inner mandrel to define the shape. Further, a molding cycle should require only approximately fifteen seconds, instead of the approximate ten minute processing time required for the mandrel molding of U.S. Pat. No. 3,908,704. Whereas the one-piece embodiment of FIG. 8 does not rely upon a distensible elastomeric collar, a semi-rigid polypropylene material is preferred. Semi-rigid polypropylene is commonly used with an FHB series blow molding machine, and has the ability to define primary and secondary frangible sections that will separate in this embodiment, in the same fashion shown for previous embodiments.

The embodiment of FIG. 8, therefore, also is a universal flashing for three vent pipe diameters, for example, that is defined with pull tabs to allow a user quickly to accommodate a 1.5, 2.0 or 3.0 inch vent pipe. The accordian section 312 also naturally accommodates vent pipes that extend at various elevations, above a roof line, without further cutting or flashing manipulation. The vertical collapsible section 312 would be shipped to a user in the collapsed section, whereby each upper leg, 318 is nested in a stable fashion on a lower leg, 320, due to the fact that each upper leg is slightly longer than the lower leg, all as further illustrated by U.S. Pat. No. 3,908,704. The outer connecting web, 319 and the inner connecting web 321 are of a sufficiently thin cross-section to permit each longer upper leg 318 to nest over a shorter lower leg, 320 without objectionable spring back. Since the blow molded material is semi-rigid, there will be a tendency for the flashing unit to remain in the expanded position that naturally is defined by dropping the collapsed flashing downwardly over a vent pipe, and securing the base, 306, upon a roof surface.

Having described several embodiments of the invention, it is to be understood that the invention is to be defined by the scope of the appended claims.

I claim:

1. An improved roof flashing elastomeric collar with an inner surface and an outer surface and adapted to seal against more than one size of a vent pipe passing vertically through a central opening in said collar and comprising a circular base, a central opening comprising a first annular ring defined by a first separation circle and a second separation circle, and at least one additional annular ring outwardly from the first annular ring, where said at least one additional annular ring is frangibly separable from the first annular ring at said second separation circle and frangibly separable from said elastomeric collar at a third separation circle, and said first, second, and third separation circles concentrically are arranged, in order, outwardly from the central opening, wherein further each of said second and third separation circles include an arcuate primary frangible segment of reduced wall thickness to assist in the removal of each annular ring, and a pull tab extends substantially vertically from the outer surface of each annular ring at a location proximate to the outer separation circle of that ring and immediately above an associated arcuate primary frangible segment of a respective separation circle, so as to permit a selective removal of each annular ring.

2. An improved elastomeric collar according to claim 1, wherein each of said second and third separation circles further include a secondary frangible section that extends from either end of said arcuate primary frangible segment, around a respective separation circle.

3. An improved elastomeric collar according to claim 1, wherein said first annular ring defines a second pull tab located adjacent to said second separation circle and a third pull table is located adjacent to said third separation circle, wherein further said second and third pull tabs each have convex outer surfaces and concave inner surfaces and are disposed on opposite sides of a vertical plane bisecting said elastomeric collar.

4. An improved elastomeric collar according to claim 3, wherein the second pull tab and the third pull tab are spaced at an angle of approximately 15-20 degrees with respect to a vertical plane bisecting said flashing, and disposed so as to have their respective convex surfaces facing upwardly when said flashing is positioned upon a roof having an inclined pitch, in an intended use.

5. In an elastomeric collar with an inner surface and an outer surface that is adapted for use with a base member, and adapted to seal against the outer diameter of more than one vent pipe size passing vertically through a central opening in said elastomeric collar, the improvement of an elastomeric collar having a circular base that is adapted for a mechanical interconnect to a hard base member, and further comprising a first diameter defining a first separation circle that is adapted to be distended to define a first primary seal against the outer diameter of a first diameter vent pipe, a first annular ring radially outward from the first diameter and having an outer diameter defined by a second separation circle, and a second annular ring radially outward from the second separation circle having an outer diameter defined by a third separation circle;

wherein, further, a first pull tab proximate to said second separation circle, extends upwardly from an outer surface of said first annular ring, and a second pull tab proximate to said third separation circle, extends upwardly from an outer surface of said second annular ring, and;

each of said pull tabs are located on opposite sides of a vertical plane bisecting said collar and each of said second and third separation circles include an arcuate primary frangible segment of reduced wall thickness to assist in the removal of each annular ring, and each of said pull tabs extend immediately above an associated arcuate primary frangible segment of a respective separation circle, for selective removal of each annular ring.

6. An elastomeric collar according to claim 5, wherein said second separation circle further comprises a secondary frangible section, and said third separation circle further comprises a secondary frangible section, wherein said secondary frangible sections of each of said second and third separation circles extend from either end of a respective arcuate primary frangible segment, around a respective separation circle.

* * * * *